US009276320B2

(12) United States Patent
Wu et al.

(10) Patent No.: US 9,276,320 B2
(45) Date of Patent: Mar. 1, 2016

(54) MULTI-BAND ANTENNA

(75) Inventors: Yi-Feng Wu, Hsinchu County (TW); Wei-Shan Chang, Hsinchu County (TW)

(73) Assignee: Wistron NeWeb Corp., Hsinchu County (TW)

( * ) Notice: Subject to any disclaimer, the term of this patent is extended or adjusted under 35 U.S.C. 154(b) by 88 days.

(21) Appl. No.: 13/274,611

(22) Filed: Oct. 17, 2011

(65) Prior Publication Data

US 2012/0306709 A1 Dec. 6, 2012

(30) Foreign Application Priority Data

Jun. 3, 2011 (TW) ..... 100119574 A

(51) Int. Cl.

| | |
|---|---|
| ***H01Q 1/38*** | (2006.01) |
| ***H01Q 9/42*** | (2006.01) |
| ***H01Q 1/24*** | (2006.01) |
| ***H01Q 5/371*** | (2015.01) |
| ***H01Q 5/378*** | (2015.01) |

(52) U.S. Cl.

CPC ..... *H01Q 9/42* (2013.01); *H01Q 1/243* (2013.01); *H01Q 5/371* (2015.01); *H01Q 5/378* (2015.01)

(58) Field of Classification Search

USPC ..... 343/767, 700 MS, 702

See application file for complete search history.

(56) References Cited

U.S. PATENT DOCUMENTS

| | | | | |
|---|---|---|---|---|
| 7,050,010 | B2 | 5/2006 | Wang et al. | |
| 7,425,924 | B2 * | 9/2008 | Chung | H01Q 1/38 343/702 |
| 7,683,840 | B2 * | 3/2010 | Lin | H01Q 1/243 343/702 |
| 2003/0103010 | A1 | 6/2003 | Boyle | |
| 2004/0222923 | A1 | 11/2004 | Erkocevic | |
| 2008/0180333 | A1 * | 7/2008 | Martiskainen et al. | H01Q 1/243 343/722 |
| 2009/0109098 | A1 * | 4/2009 | Hung | H01Q 1/243 343/700 MS |

(Continued)

FOREIGN PATENT DOCUMENTS

| | | | |
|---|---|---|---|
| CN | 1596486 | A | 3/2005 |
| CN | 101106211 | A | 1/2008 |

(Continued)

OTHER PUBLICATIONS

Search report appended in an Office Action issued to Taiwances counterpart application No. 100119574 by the Taiwan Intellectual Property Office on Jul. 22, 2014 along with an English translation thereof.

(Continued)

*Primary Examiner* — Hoang V Nguyen
*Assistant Examiner* — Hai Tran
(74) *Attorney, Agent, or Firm* — Dickstein Shapiro LLP

(57) ABSTRACT

A multi-band antenna is to be electrically connected to a transceiving terminal of a radio frequency circuit by a feeding unit and includes a grounding section, a feed-in section electrically connected to the feeding unit, first and second radiator arms respectively disposed at opposite lateral sides of the feed-in section and electrically connected to the feed-in section, and a first coupling component. The first and second radiator arms are configured to generate first and second resonant modes, respectively. When the multi-band antenna transceives radio frequency signals, the second radiator arm and the first coupling component generate a coupling effect such that the first coupling component generates a third resonant mode. Center frequencies of the first, second, and third resonant modes are different from each other.

10 Claims, 8 Drawing Sheets

(56) References Cited

U.S. PATENT DOCUMENTS

| | | | | |
|---|---|---|---|---|
| 2010/0123631 | A1* | 5/2010 | Chang et al. ..... | H01Q 1/243 343/700 MS |
| 2011/0181487 | A1 | 7/2011 | Kim et al. | |

FOREIGN PATENT DOCUMENTS

| | | | |
|---|---|---|---|
| CN | 101557030 | A | 10/2009 |
| CN | 101911388 | A | 12/2010 |
| TW | 200919830 | A | 5/2009 |
| TW | M391734 | U1 | 11/2010 |

OTHER PUBLICATIONS

Chinese Search Report issued for counterpart application CN 2011101505103, dated Mar. 19, 2014 (English translation), 2014.

Search Report appended in an Office Action issued to Chinese counterpart Application No. 2011101505103 by the State Intellectual Property Office of the P.R.C. on Sep. 15, 2014 along with an English translation thereof, 2014.

* cited by examiner

MULTI-BAND ANTENNA

CROSS-REFERENCE TO RELATED APPLICATION

This application claims priority of Taiwanese Application No. 100119574, filed on Jun. 3, 2011.

BACKGROUND OF THE INVENTION

1. Field of the Invention

The present invention relates to an antenna, more particularly to a multi-band antenna, the entire disclosure of which is incorporated herein by reference.

2. Description of the Related Art

In recent years, more and more consumer electronic devices with communication functionality have been developed with the growing availability of various wireless communication frequency bands. Since different generations of communication systems are being introduced in every few years, smart phones and portable computers need to be compatible not only with older communication systems such as Second Generation Wireless Telephone Technology (2G) and 3rd Generation (3G) wireless telephone technology, but also with newer communication systems such as Long Term Evolution (LTE) systems. Therefore, it is desirable to have an electronic device capable of operating at various wireless communication frequency bands.

A conventional solution for the electronic device to be compatible with various frequency bands is to provide multiple antennas, e.g., one of the antennas is for 2 G communication system, and another one of the antennas is for 3 G communication system. However, more space is required in such electronic devices, thereby making it difficult to reduce the size of the electronic devices so as to comply with the current trend toward miniaturization. Consequently, it is desirable to have a single antenna capable of operating at various wireless communication frequency bands.

Referring to FIG. 1, U.S. Pat. No. 7,050,010 discloses a multi-band antenna compatible with dual-bands and having a return loss frequency response shown in FIG. 2. One of resonant frequency bands approximate to 2.4 GHz is composed of a resonant mode, and the other one of the resonant frequency bands approximate to 5 GHz is composed of two resonant modes. Although the above mentioned antenna is capable of operating at multiple frequency bands, the frequency band approximate to 2.4 GHz is composed of a single resonant mode and thus has a limited bandwidth. Hence, it is difficult to satisfy operating requirements for LIE system (13/17) and GSM850/GSM900 systems (704 MHz~960 MHz) by simply adjusting the size of the antenna.

Referring to FIG. 3, Taiwanese Utility Model No. M391734 discloses a Long Term Evolution (LTE) antenna that is simultaneously compatible with LTE band 13, Global System for Mobile Communications (GSM), Digital Cellular System (DCS), Personal Communication System (PCS), and Wideband Code Division Multiple Access (WCDMA) communication systems and that has a return loss frequency response shown in FIG. 4. The LTE antenna comprises a circuit board 11, a monopole antenna 12, a coupling element 13 having first and second coupling portions 131, 132, and a capacitor 14. The first coupling portion 131, the monopole antenna 12, and the second coupling portion 132 overlap in a vertical direction in the drawing such that electromagnetic energy thereof couple with each other. Once the resonant mode covering a frequency band ranging from 1710 MHz~2170 MHz is adjusted, the resonant mode covering frequency band ranging from 746 MHz~946 MHz will be affected, thereby resulting in frequency offset and impedance mismatch, and increasing difficulty in designing the antenna. Additionally, use of the capacitor 14 is required in such antenna, which results in a cumbersome manufacturing process and increase of manufacturing cost.

SUMMARY OF THE INVENTION

Therefore, an object of the present invention is to provide a multi-band antenna that can alleviate the above disadvantages of the prior art.

Accordingly, the multi-band antenna of the present invention is to be electrically connected to a transceiving terminal of a radio frequency circuit by a feeding unit and comprises a grounding section, a feed-in section, a first radiator arm, a second radiator arm, and a first coupling component. The grounding section includes a side edge extending in a first direction. The feed-in section is adjacent to the side edge of the grounding section and is to be electrically connected to the feeding unit. The feed-in section is disposed to transceive radio frequency signals to and from the feeding unit and the transceiving terminal of the radio frequency circuit. The first radiator arm is disposed at a first lateral side of the feed-in section, and includes a free end portion, and a connecting end portion that is electrically connected to the feed-in section. The first radiator arm is configured to generate a first resonant mode. The second radiator arm is disposed at a second lateral side of the feed-in section opposite to the first lateral side, and includes a free end portion, a connecting end portion that is electrically connected to the feed-in section, and an extension arm portion that extends in the first direction and that connects the free end portion of the second radiator arm to the connecting end portion of the second radiator arm. The second radiator arm is configured to generate a second resonant mode. The first coupling component is free of physical contact with the second radiator arm and the feed-in section, and includes a grounding arm portion that is disposed at the second lateral side of the feed-in section and that extends from the side edge of the grounding section in a second direction transverse to the first direction, and a coupling arm portion that extends from the grounding arm portion toward the feed-in section in the first direction, that is spaced apart from and disposed side-by-side with the extension arm portion of the second radiator arm, and that has a free end which is disposed at the first lateral side with respect to the free end portion of the second radiator arm. The free end of the coupling arm is adjacent to the feed-in section and is free of overlap with the first radiator arm in the second direction. When the multi-band antenna transceives radio frequency signals, the extension arm portion of the second radiator arm and the coupling arm portion of the first coupling component generate a coupling effect such that the first coupling component generates a third resonant mode. Center frequencies of the first, second, and third resonant modes are different from each other.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
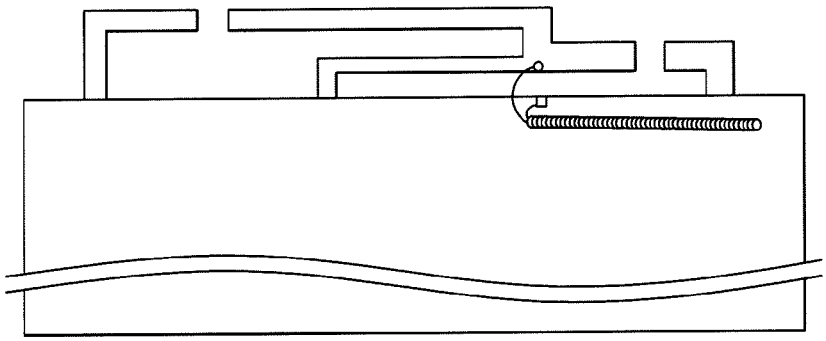
FIG. 1 PRIOR ART
FIG. 1 is a schematic diagram of a conventional dual-band antenna.
Figure 2:
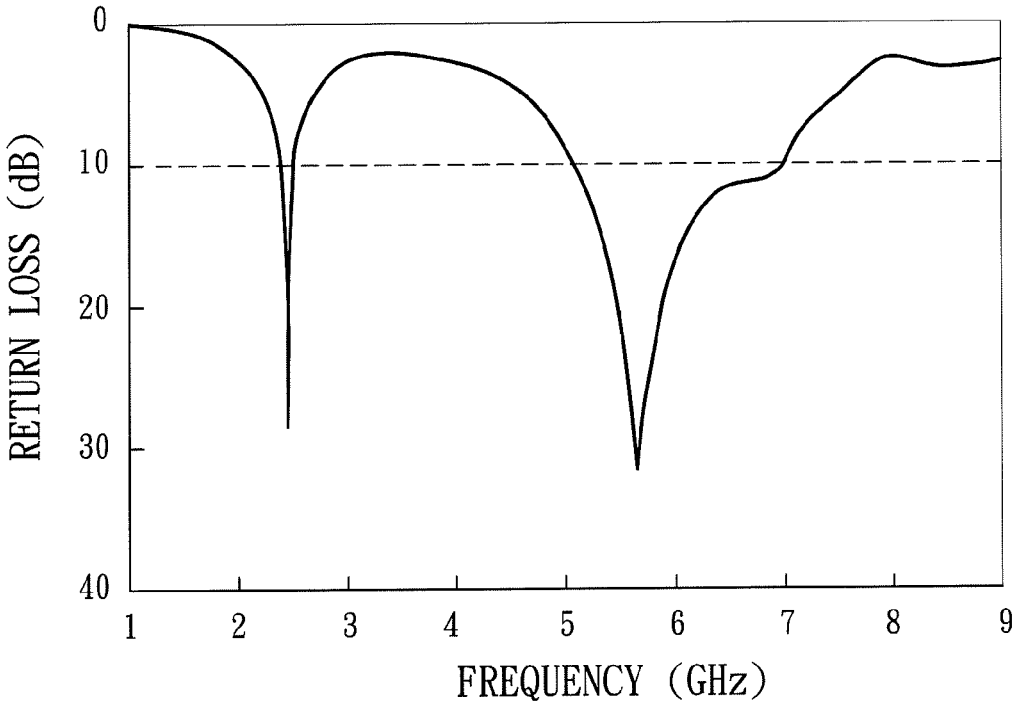
FIG. 2 PRIOR ART
FIG. 2 is a return loss frequency response plot of the conventional dual-band antenna.

Before the present invention is described in greater detail, it should be noted that like reference numerals are used to indicate corresponding or analogous elements throughout the accompanying disclosure.

Figure 5:
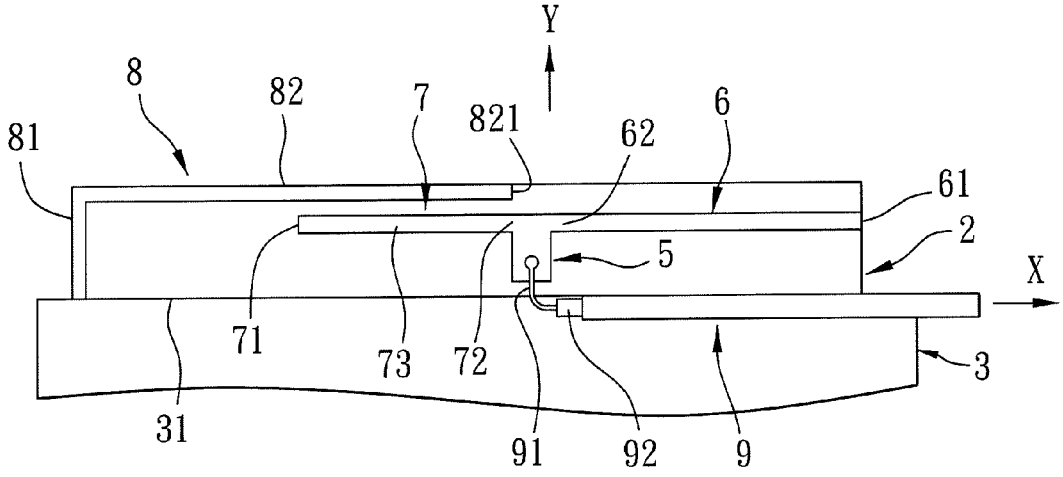
FIG. 5 is a schematic diagram of a first embodiment of a multi-band antenna according to the present invention, illustrating a first coupling component spaced apart from and disposed side-by-side with respect to and above a second radiator arm in the drawing.

Referring to FIG. 5, a first embodiment of a multi-band antenna of the present invention is shown. In this embodiment, the multi-band antenna is applied to an electronic device such as a notebook computer. The multi-band antenna comprises a grounding section 3, a feed-in section 5 formed on a circuit board 2 of an electronic device (not shown), a first radiator arm 6, a second radiator arm 7, a first coupling component 8, and a feeding unit 9.

The feeding unit 9 is a coaxial cable electrically connecting the multi-band antenna to a transceiving terminal of a radio frequency circuit (not shown) in this embodiment.

The grounding section 3 includes a side edge 31 extending in a first direction (X), i.e., a left-to-right direction in the drawing. The feed-in section 5 is adjacent to the side edge 31 of the grounding section 3 and is electrically connected to an inner core 91 of the feeding unit 9. A shielding layer 92 of the feeding unit 9 is electrically connected to the grounding section 3. The feed-in section 5 is disposed to transceive radio frequency signals to and from the feeding unit 9 and the transceiving terminal of the radio frequency circuit.

The first radiator arm 6 extends along a substantially straight line in the first direction (X) and is disposed at a right lateral side of the feed-in section 5 in the drawing. The first radiator arm 6 includes a free end portion 61 and a connecting end portion 62 that is electrically connected to the feed-in section 5.

The second radiator arm 7 is disposed at a left lateral side of the feed-in section 5 opposite to the right lateral side in the drawings, and includes a free end portion 71, a connecting end portion 72 that is electrically connected to the feed-in section 5, and an extension arm portion 73 that extends in the first direction (X) and that connects the free end portion 71 to the connecting end portion 72.

The first coupling component 8 is free of physical contact with the second radiator arm 7 and the feed-in section 5, and includes a grounding arm portion 81 that is disposed at the left lateral side of the feed-in section 5 in the drawing and that extends from the side edge 31 of the grounding section 3 in a second direction (Y) transverse to the first direction (X), and a coupling arm portion 82 that extends from the grounding arm portion 81 toward the feed-in section 5 in the first direction (X), that is spaced apart from and disposed side-by-side with the extension arm portion 73 of the second radiator arm 7, and that has a free end 821. The free end 821 is disposed at the right lateral side with respect to the free end portion 71 of the second radiator arm 7 in the drawing, is adjacent to the feed-in section 5, and is free of overlap with the first radiator arm 6 in the second direction (Y).

Figure 6:
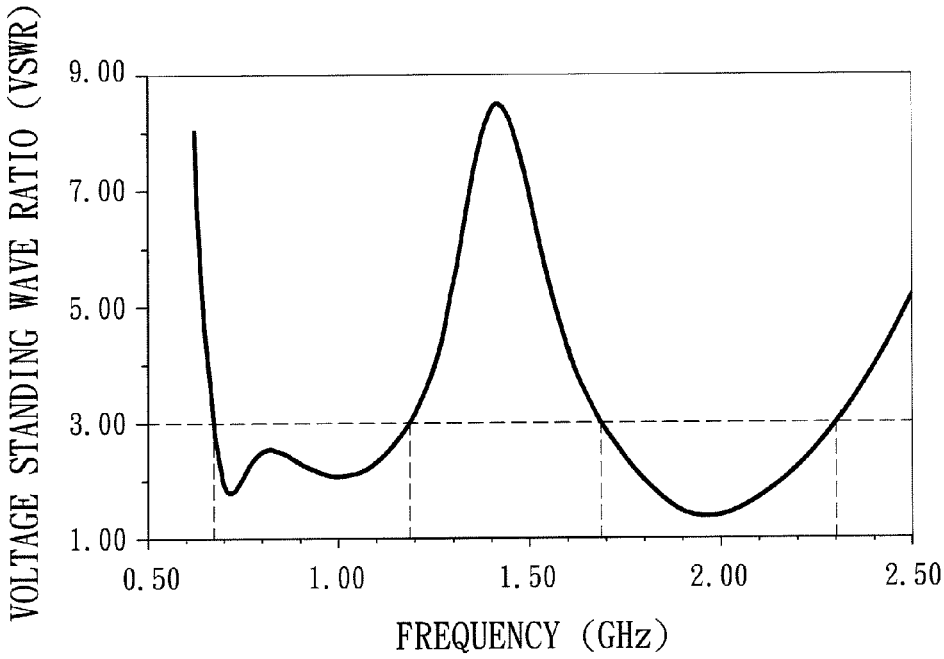
FIG. 6 is a Voltage Standing Wave Ratio (VSWR) plot of the first embodiment.

Further referring to FIG. 6, when the multi-band antenna transceives the radio frequency signals, the first radiator arm 6 is configured to generate a first resonant mode and the second radiator arm 7 is configured to generate a second resonant mode. Additionally, the extension arm portion 73 of the second radiator arm 7 and the coupling arm portion 82 of the first coupling component 8 generate a coupling effect such that the first coupling component 8 generates a third resonant mode. It should be noted that center frequencies of the first, second, and third resonant modes are different from each other.

The first and third resonant modes form a dual mode covering a first frequency band ranging from 704 MHz~960 MHz (LTE band 13/LTE band 17/GSM850/GSM 900), and the second resonant mode covers a second frequency band ranging from 1710 MHz~2170 MHz (DCS/PCS/WCDMA) that is different from the first frequency band.

FIG. 6 also illustrates that VSWR values of the multi-band antenna at frequencies within the first and second frequency bands are smaller than 3. Therefore, radio frequency signals within the above mentioned frequency bands may be transceived effectively by the multi-band antenna of the embodiment.

Figure 7:
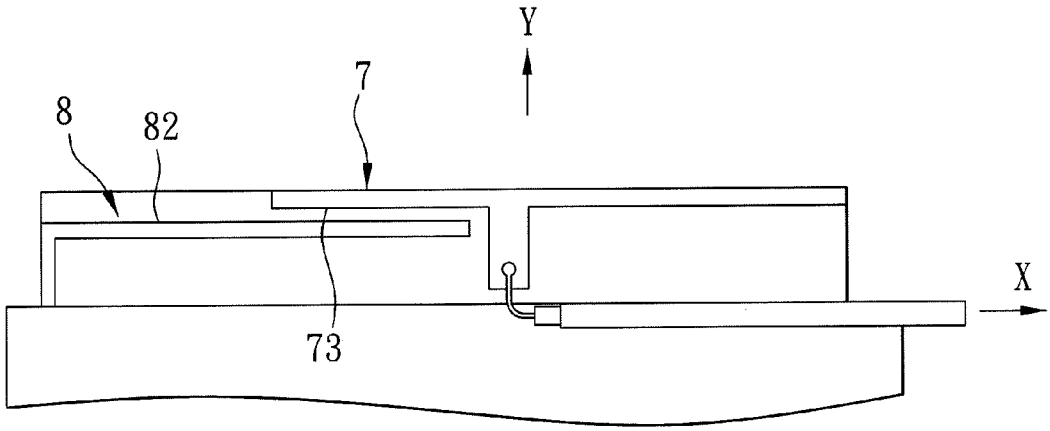
FIG. 7 is a modification of the first embodiment, illustrating the first coupling component spaced apart from and disposed side-by-side below the second radiator arm in the drawing.

Referring to FIG. 7, there is shown a second aspect of the first embodiment. The coupling arm portion 82 of the first coupling component 8 is spaced apart from and disposed side-by-side below the extension arm portion 73 of the second radiator arm 7 in the drawing.

Figure 8:
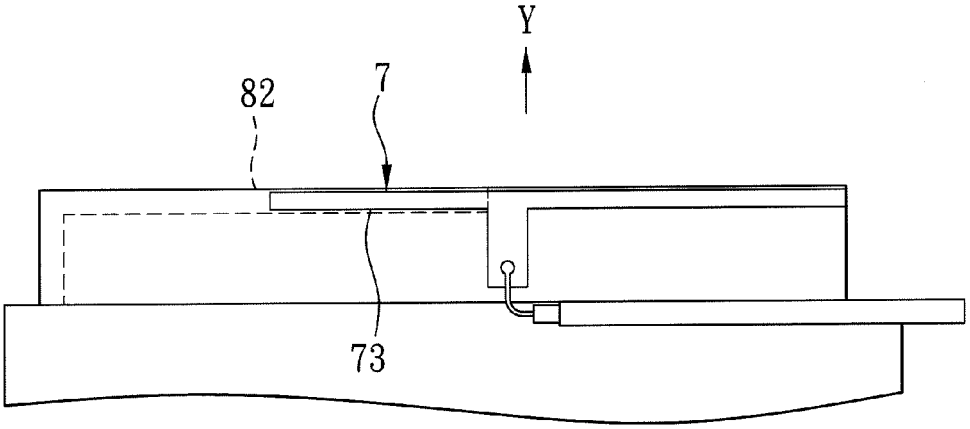
FIG. 8 is another modification of the first embodiment, illustrating a coupling arm portion of the first coupling component disposed to overlap while being free of physical contact with the second radiator arm.

Referring to FIG. 8, a third aspect of the first embodiment is shown, in which the coupling arm portion 82 and the extension arm portion 73 of the second radiator arm 7 overlap in the second direction (Y) and are free of physical contact with each other.

Figure 9:
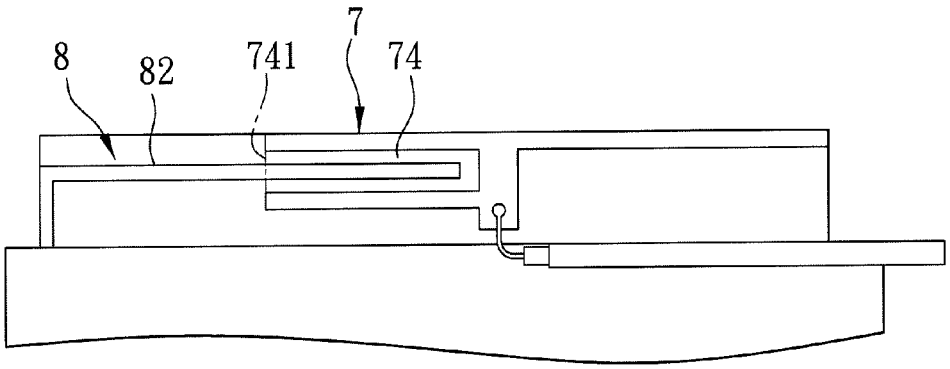
FIG. 9 is still another modification of the first embodiment, illustrating the second radiator arm formed with a slit.

Referring to FIG. 9, a fourth aspect of the first embodiment is shown. The second radiator arm 7 further includes a slit 74 having an opening 741. The coupling arm portion 82 of the first coupling component 8 extends into the slit 74 through the opening 741 such that capacitive coupling between the second radiator arm 7 and the coupling arm portion 82 is increased.

Figure 10:
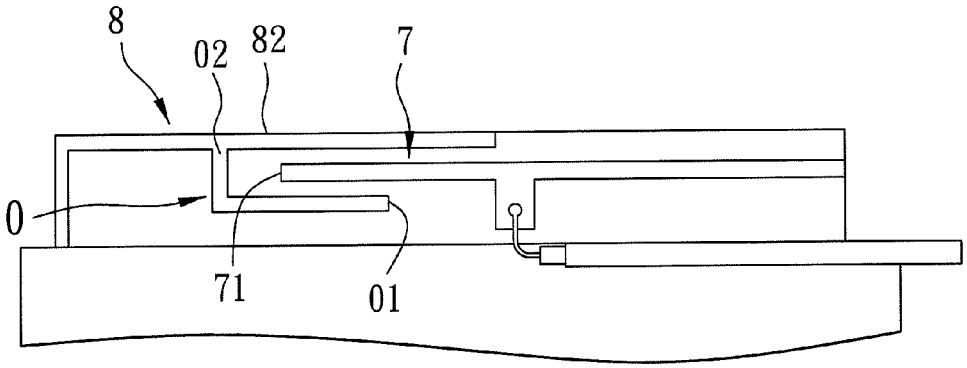
FIG. 10 is a schematic diagram of a second embodiment of the multi-band antenna according to the present invention, illustrating the antenna further comprising a second coupling component.

As shown in FIG. 10, a second embodiment of the multi-band antenna is similar to the first embodiment illustrated in FIG. 5. The multi-band antenna in this embodiment further comprises a second coupling component 0 that includes a free end portion 01 disposed at the right lateral side with respect to the free end portion 71 of the second radiator arm 7 in the drawing, and a connecting end portion 02 electrically connected to the first coupling component 8. When the multi-band antenna transceiver the radio frequency signals, the second coupling component 0 and the second radiator arm 7 generate a coupling effect and generate a fourth resonant mode. The fourth resonant mode and the second resonant mode form another dual mode covering the second frequency band. Frequencies in the second frequency band are higher than those in the first frequency band.

Figure 11:
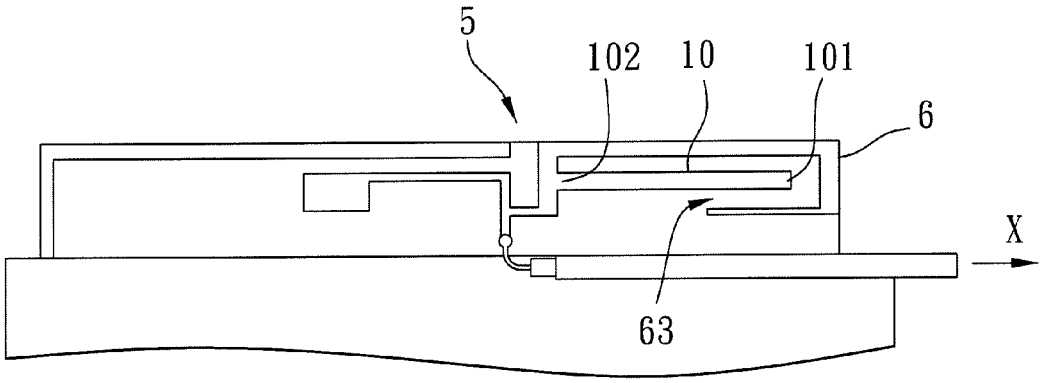
FIG. 11 is a schematic diagram of a third embodiment of the multi-band antenna according to the present invention, illustrating the antenna further comprising a third radiator arm as compared to the first embodiment shown in FIG. 5.
Figure 12:
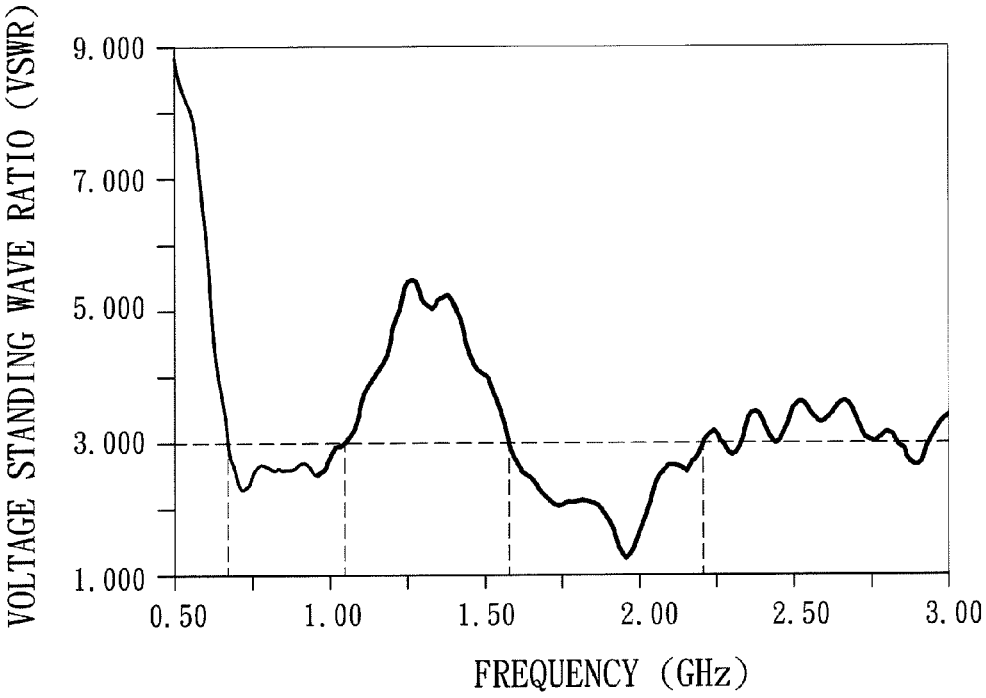
FIG. 12 is a Voltage Standing Wave Ratio (VSWR) plot showing VSWR values of the third embodiment.

Referring to FIGS. 11 and 12, a third embodiment of the multi-band antenna is shown to comprise all components illustrated in the first embodiment. In this embodiment, the multi-band antenna further comprises a third radiator arm 10 that is disposed at the right lateral side of the feed-in section 5 in the drawing without intersecting the first radiator arm 6, and that includes a free end portion 101 and a connecting end portion 102 electrically connected to the feed-in section 5. Additionally, the first radiator arm 6 has a generally U-shaped profile which has an opening 63 that opens toward the feed-in section 5. The third radiator arm 10 extends from the feed-in section 5 toward and into the opening 63 of the first radiator arm 6 along a substantially straight line in the first direction (X).

When the multi-band antenna transceives radio frequency signals, the third radiator arm 10 is configured to generate a fourth resonant mode. The fourth resonant mode and the second resonant mode form a dual mode covering the second frequency band. Frequencies in the second frequency band are higher than those in the first frequency band.

Figure 13:
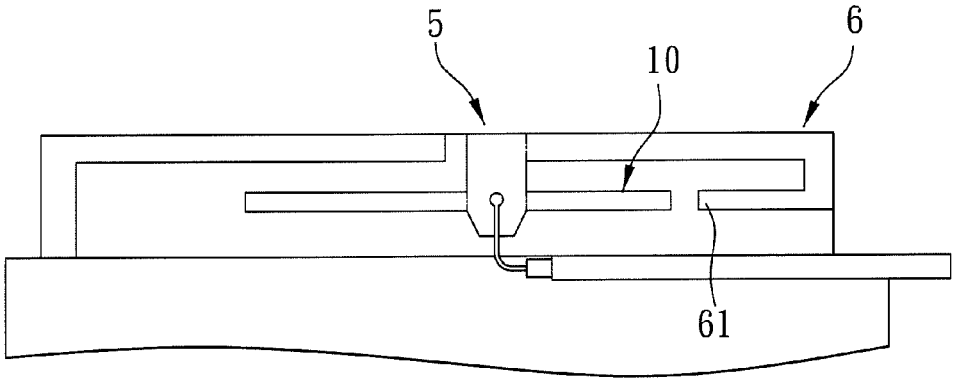
FIG. 13 is a modification of the third embodiment, illustrating the third radiator arm extending from a feed-in section toward a free end portion of the first radiator arm.

Referring to FIG. 13, a modified aspect of the third embodiment (see FIG. 11) is shown. The third radiator arm 10 extends from the feed-in section 5 toward the free end portion 61 of the first radiator arm 6 to terminate proximate thereto.

Figure 14:
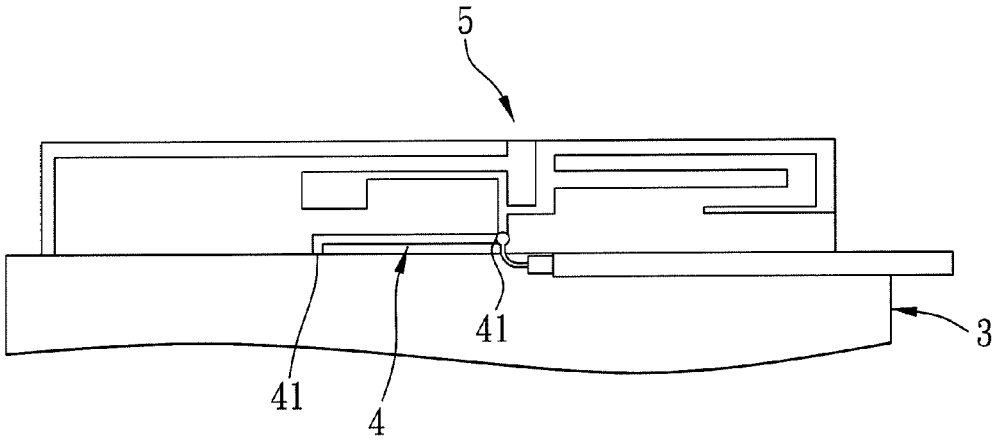
FIG. 14 is a schematic diagram of a fourth embodiment of the multi-band antenna according to the present invention, illustrating the antenna further comprising an adjusting arm disposed at a left side of the feed-in section in the drawing.
Figure 15:
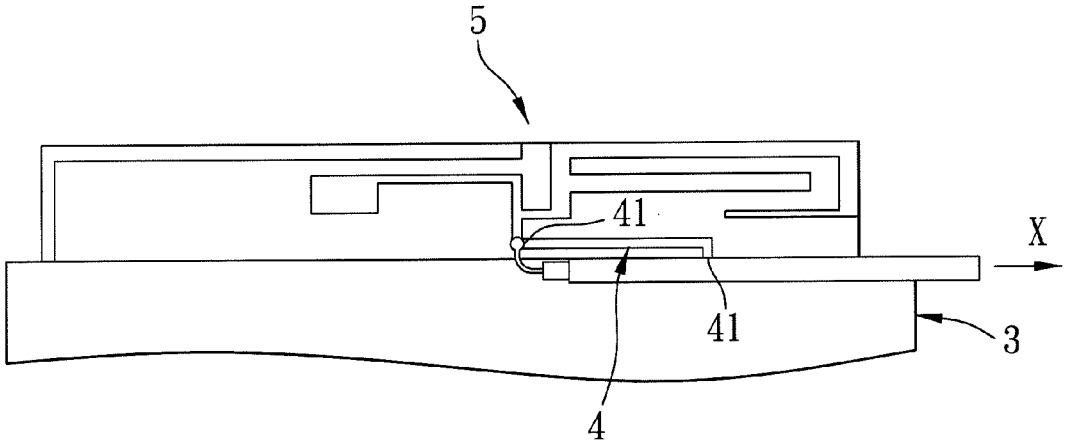
FIG. 15 is a modification of the fourth embodiment, illustrating the adjusting arm disposed at a right side of the feed-in section in the drawing.

Referring to FIGS. 14 and 15, a fourth embodiment of the multi-band antenna is shown to comprise all elements disclosed in the third embodiment (see FIG. 11). The multi-band antenna in this embodiment further comprises an inverted-L shaped adjusting arm 4 having two ends 41 electrically connected to the feed-in section 5 and the grounding section 3, respectively so as to adjust impedance matching of the multi-band antenna. It should be noted that the adjusting arm 4 is not limited to the inverted-L shaped configuration, and may be disposed atone of the right and left lateral sides with respect to the feed-in section 5 in the drawing as long as the ends 41 thereof are electrically connected to the feed-in section 5 and the grounding section 3, respectively.

Figure 3:
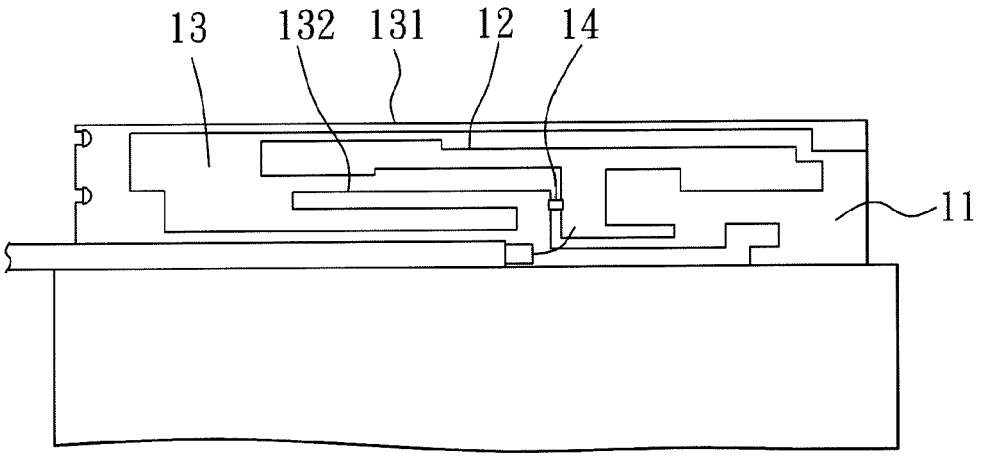
FIG. 3 PRIOR ART
FIG. 3 is a schematic diagram of a conventional long term evolution (LTE) antenna.
Figure 4:
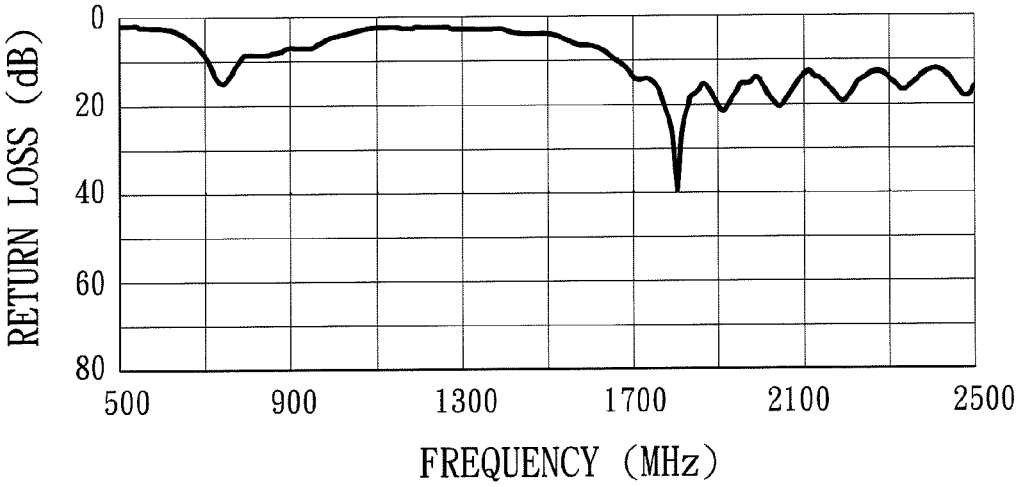
FIG. 4 PRIOR ART
FIG. 4 is a return loss frequency response plot of the conventional LTE antenna.

To sum up, the first coupling component 8 is free of overlap with the first radiator arm 6 and the third radiator arm 10 in the second direction (Y), and the second coupling component 0 is free of overlap with the first radiator arm 6 in the second direction (Y), such that it is relatively simple to tune frequency offset and perform impedance matching for the multi-band antenna among the first, second, third, and fourth resonant modes as compared to the conventional multi-band antenna illustrated in FIG. 3. Also, the use of the capacitor 14 can be omitted in the present invention to thereby reduce manufacturing costs. Additionally, the first frequency band ranging from 704 MHz~960 MHz of the multi-band antenna is composed of the first and third resonant modes, and thus has an increased operation bandwidth as compared to frequency band of the conventional multi-band antenna illustrated in FIG. 1. Consequently, the multi-band antenna of this invention is simultaneously compatible with various communication systems.

While the present invention has been described in connection with what are considered the most practical embodiments, it is understood that this invention is not limited to the disclosed embodiment but is intended to cover various arrangements included within the spirit and scope of the broadest interpretation so as to encompass all such modifications and equivalent arrangements.

What is claimed is:

1. A multi-band antenna to be electrically connected to a transceiving terminal of a radio frequency circuit by a feeding unit, comprising:

a grounding section including a side edge extending in a first direction;

a feed-in section adjacent to said side edge of said grounding section without a shorting path therebetween, said feed-in section being electrically connected to the feeding unit, and said feed-in section being disposed to transceive radio frequency signals to and from the feeding unit and the transceiving terminal of the radio frequency circuit;

a first radiator arm disposed at a first lateral side of said feed-in section, said first radiator arm including a free end portion, and a connecting end portion that is electrically connected to said feed-in section, and being configured to generate a first resonant mode;

a second radiator arm disposed at a second lateral side of said feed-in section opposite to said first lateral side, said second radiator arm including a free end portion, a connecting end portion that is electrically connected to said feed-in section, and an extension arm portion that extends in the first direction and that connects said free end portion of said second radiator arm to said connecting end portion of said second radiator arm, said second radiator arm being configured to generate a second resonant mode;

a first coupling component free of physical contact with said second radiator arm and said feed-in section, and including a grounding arm portion that is disposed at the second lateral side of said feed-in section and that extends from said side edge of said grounding section in a second direction transverse to the first direction, and a coupling arm portion that extends from said grounding arm portion toward said feed-in section in the first direction, that is spaced apart from and disposed side-by-side with said extension arm portion of said second radiator arm, that is free of overlap with said first radiator arm in the second direction and that has a free end which is disposed at the first lateral side with respect to said free end portion of said second radiator arm and which is adjacent to said feed-in section, wherein, when said multi-band antenna transceives radio frequency signals, said extension arm portion of said second radiator arm and said coupling arm portion of said first coupling component generate a coupling effect such that said first coupling component generates a third resonant mode, center frequencies of the first, second, and third resonant modes being different from each other; and a third radiator arm that is disposed at the first lateral side of said feed-in section without intersecting said first radiator arm, and that includes a free end portion and a connecting end portion electrically connected to said feed-in section, said third radiator arm being configured to generate a fourth resonant mode, center frequency of the fourth resonant mode being different from those of the first, second, and third resonant modes.

2. The multi-band antenna as claimed in claim 1, wherein said first radiator arm has a generally U-shaped profile which has an opening that opens toward said feed-in section, said third radiator arm extending along a substantially straight line in the first direction.

3. The multi-band antenna as claimed in claim 2, wherein said third radiator arm extends from said feed-in section toward said opening of said first radiator arm in the first direction.

4. The multi-band antenna as claimed in claim 2, wherein said third radiator arm extends from said feed-in section toward said free end portion of said first radiator arm to terminate proximate thereto.

5. The multi-band antenna as claimed in claim 1, wherein the first and third resonant modes form a dual mode covering a first frequency band, and the second and fourth resonant modes form another dual mode covering a second frequency band that is different from the first frequency band.

6. The multi-band antenna as claimed in claim 5, wherein frequencies in the second frequency band are higher than those in the first frequency band.

7. The multi-band antenna as claimed in claim 1, wherein said first radiator arm extends along a substantially straight line in the first direction.

8. A multi-band antenna to be electrically connected to a transceiving terminal of a radio frequency circuit by a feeding unit, comprising:

a grounding section including a side edge extending in a first direction;

a feed-in section adjacent to said side edge of said grounding section without a shorting path therebetween, said feed-in section being electrically connected to the feeding unit, said feed-in section being disposed to transceive radio frequency signals to and from the feeding unit and the transceiving terminal of the radio frequency circuit;

a first radiator arm disposed at a first lateral side of said feed-in section, said first radiator arm including a free end portion, and a connecting end portion that is electrically connected to said feed-in section, and being configured to generate a first resonant mode;

a second radiator arm disposed at a second lateral side of said feed-in section opposite to said first lateral side, said second radiator arm including a free end portion, a connecting end portion that is electrically connected to said feed-in section, and an extension arm portion that extends in the first direction and that connects said free end portion of said second radiator arm to said connecting end portion of said second radiator arm, said second radiator arm being configured to generate a second resonant mode;

a first coupling component free of physical contact with said second radiator arm and said feed-in section, and including a grounding arm portion that is disposed at the second lateral side of said feed-in section and that extends from said side edge of said grounding section in a second direction transverse to the first direction, and a coupling arm portion that extends from said grounding arm portion toward said feed-in section in the first direction, that is spaced apart from and disposed side-by-side with said extension arm portion of said second radiator arm, that is free of overlap with said first radiator arm in the second direction and that has a free end which is disposed at the first lateral side with respect to said free end portion of said second radiator arm and which is adjacent to said feed-in section, wherein, when said multi-band antenna transceives radio frequency signals, said extension arm portion of said second radiator arm and said coupling arm portion of said first coupling component generate a coupling effect such that said first coupling component generates a third resonant mode, center frequencies of the first, second, and third resonant modes being different from each other; and a second coupling component that includes a free end portion disposed at the first lateral side with respect to said free end portion of said second radiator arm, and a connecting end portion electrically connected to said first coupling component, wherein, when said multi-band antenna transceives radio frequency signals, said second coupling component and said second radiator arm generate a coupling effect and generate a fourth resonant mode.

9. The multi-band antenna as claimed in claim 8, wherein covering a first frequency band, and the second and fourth resonant modes form another dual mode covering a second frequency band that is different from the first frequency band.

10. A multi-band antenna to be electrically connected to a transceiving terminal of a radio frequency circuit by a feeding unit, comprising:

a grounding section including a side edge extending in a first direction;

a feed-in section adjacent to said side edge of said grounding section without a shorting path therebetween, said feed-in section being electrically connected to the feeding unit, said feed-in section being disposed to transceive radio frequency signals to and from the feeding unit and the transceiving terminal of the radio frequency circuit;

a first radiator arm disposed at a first lateral side of said feed-in section, said first radiator arm including a free end portion, and a connecting end portion that is electrically connected to said feed-in section, and being configured to generate a first resonant mode;

a second radiator arm disposed at a second lateral side of said feed-in section opposite to said first lateral side, said second radiator arm including a free end portion, a connecting end portion that is electrically connected to said feed-in section, and an extension arm portion that extends in the first direction and that connects said free end portion of said second radiator arm to said connecting end portion of said second radiator arm, said second radiator arm being configured to generate a second resonant mode;

a first coupling component free of physical contact with said second radiator arm and said feed-in section, and including a grounding arm portion that is disposed at the second lateral side of said feed-in section and that extends from said side edge of said grounding section in a second direction transverse to the first direction, and a coupling arm portion that extends from said grounding arm portion toward said feed-in section in the first direction, that is spaced apart from and disposed side-by-side with said extension arm portion of said second radiator arm, that is free of overlap with said first radiator arm in the second direction and that has a free end which is disposed at the first lateral side with respect to said free end portion of said second radiator arm and which is adjacent to said feed-in section, wherein, when said multi-band antenna transceives radio frequency signals, said extension arm portion of said second radiator arm and said coupling arm portion of said first coupling component generate a coupling effect such that said first coupling component generates a third resonant mode, center frequencies of the first, second, and third resonant modes being different from each other; and wherein said second radiator arm further includes a slit having an opening, said coupling arm portion of said first coupling component extending into said slit through said opening.

* * * * *